US005586933A

United States Patent [19]

Sawyer et al.

[11] Patent Number: 5,586,933

[45] Date of Patent: Dec. 24, 1996

[54] HEATING, VENTILATING AND AIR CONDITIONING SYSTEMS

[75] Inventors: Colin Sawyer, Barming; John Wallis, Warrington; Peter Bartingale, Margate, all of England

[73] Assignee: Hunter Technical Developments Limited, Jersey, Channel Islands

[21] Appl. No.: 333,557

[22] Filed: Nov. 2, 1994

[30] Foreign Application Priority Data

Nov. 2, 1993 [GB] United Kingdom ..... 9322559

[51] Int. Cl.[6] ..... F24F 13/075

[52] U.S. Cl. ..... 454/299; 454/315; 454/320; 454/332

[58] Field of Search ..... 454/294, 313, 454/315, 319, 320, 325, 326, 330, 331, 332

[56] References Cited

U.S. PATENT DOCUMENTS

| | | | |
|---|---|---|---|
| 3,035,504 | 5/1962 | Cline et al. | 454/315 |
| 3,236,171 | 2/1966 | Vaskov et al. | 454/332 X |
| 3,388,655 | 6/1968 | Dennis et al. | 454/315 |
| 3,587,442 | 6/1971 | Jakeway | 454/319 |
| 3,996,845 | 12/1976 | Harris | 454/320 |
| 4,060,024 | 11/1977 | Deck | 454/219 |
| 4,621,570 | 11/1986 | Bolton et al. | 454/319 |
| 4,669,371 | 6/1987 | Sarazen, Jr. et al. . | |
| 5,411,438 | 5/1995 | White et al. | 454/326 X |

FOREIGN PATENT DOCUMENTS

| | | |
|---|---|---|
| 385394 | 12/1932 | United Kingdom . |
| 698759 | 10/1953 | United Kingdom . |
| 785861 | 11/1957 | United Kingdom . |
| 1032328 | 6/1966 | United Kingdom . |
| 1085952 | 10/1967 | United Kingdom . |
| 1145229 | 3/1969 | United Kingdom . |
| 1234102 | 6/1971 | United Kingdom . |
| 1316265 | 5/1973 | United Kingdom . |
| 2204122 | 11/1988 | United Kingdom . |

*Primary Examiner*—Harold Joyce
*Attorney, Agent, or Firm*—Webb Ziesenheim Bruening Logsdon Orkin & Hanson, P.C.

[57] ABSTRACT

A grille (3) for use adjacent an outlet of a heating, ventilating or air conditioning system comprising a frame (15) and a plurality of blades (25) extending between opposed frame parts. Each blade (25) has a spindle (26) which is rotatably supported within opposed slots (21) formed in the opposed parts of the frame. The slots (21) are open at one end to permit the insertion of the blade spindle and the spindle is supported at the closed ends of the slots. The grille (3) further comprises means for retaining the blade spindles (26) in the slots (21). The retaining means comprise an element (30) mountable upon the frame (15) of the grille such that part of the retaining element (30) engages the blade spindles (26) when mounted upon the frame and prevents the spindles (26) from moving out of the open ends of the slots (21).

14 Claims, 5 Drawing Sheets

FIG 3
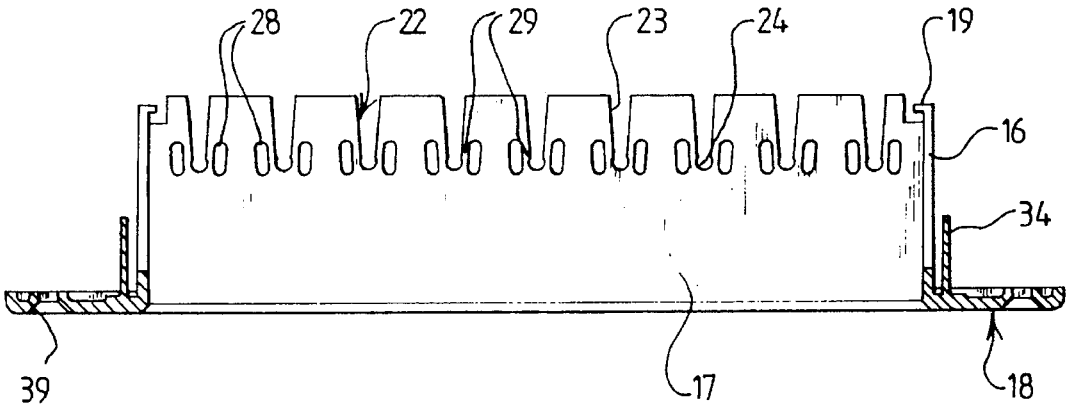
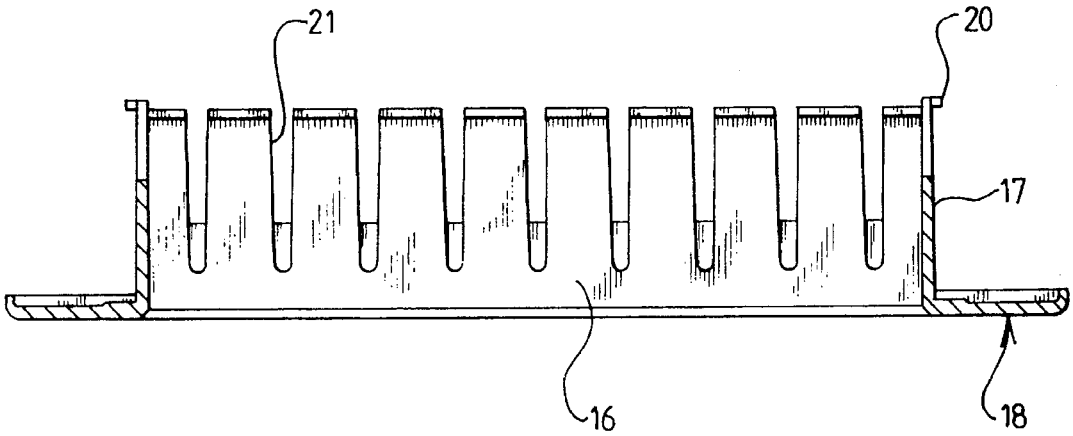
FIG 4

HEATING, VENTILATING AND AIR CONDITIONING SYSTEMS

CROSS-REFERENCE TO RELATED APPLICATION

This application contains subject matter which is generally related to the subject matter of co-pending application Ser. No. 08/035,385, filed Mar. 22, 1993, entitled "Heating, Ventilating And Air Conditioning Systems".

THE PRESENT INVENTION relates broadly to the area of heating, ventilating and air conditioning systems and more particularly to a grille for use adjacent an outlet of such a system and through which air is supplied to or extracted from a space to be ventilated. The invention also relates to an arrangement for mounting a grille adjacent an outlet of a heating, ventilating or air conditioning system.

At an outlet of a heating, ventilating or air conditioning system the ducting through which air is supplied or extracted may be connected to a so-called neck reducer or a plenum chamber which may be considered as a box which acts as an air buffer. Commonly the neck reducer or plenum chamber acts as a transition piece having a circular inlet adapted to be connected to the ducting and a rectangular outlet. A damper may be provided at the outlet of the heating, ventilating or air conditioning system, the damper having a set of blades movable to different settings between fully opened and fully closed positions in order to regulate the flow of air through the associated outlet. A grille is usually provided at the outlet, the grille being the component which is visible from within the space to be ventilated. The grille ie usually mounted so as to be flush with a ceiling (which may be a false or suspended ceiling) or a wall in which an opening is formed at the position where the outlet of the heating, ventilating or air conditioning system is to be located. When air is to be supplied to a space to be ventilated it is conveyed along the ducting of the heating, ventilating or air conditioning system and passes through the plenum chamber/neck reducer and then through the damper before entering the space to be ventilated via the grille which typically incorporate blades which serve to direct the air in a desired direction.

The grille is usually mounted in position upon a ceiling or a wall by means of mounting screws or the like which are passed through a flange formed on part of the grille and into the ceiling or wall. However, such mounting means can sometimes be unsightly and are awkward to install when one bears in mind that the grille must be held in position at the same time as the screws are located.

The present invention seeks to provide an improved grille for use adjacent an outlet of a heating, ventilating or air conditioning system.

According to a first aspect of this invention there is provided a grille for use adjacent an outlet of a heating, ventilating or air conditioning system, the grille comprising a frame and a plurality of blades extending between opposed frame parts, each blade having a spindle which is rotatably supported within opposed slots formed in the opposed parts of the frame, the slots being open at one end to permit the insertion of a blade spindle therein, the spindle being supported at the closed ends of the slots, the grille further comprising means for retaining the blade spindle in the slots, the retaining means comprising a separate retaining element mountable on the frame of the grille, the frame defining a channel and the retaining element being designed to be slidingly inserted into the channel upon the frame such that part of the retaining element engages the blade spindle when mounted upon the frame and prevents the spindle from moving out of the open ends of the slots.

Conveniently the frame of the grille comprises an upstanding wall formed with an overturned lip at its upper edge, the retaining element comprising a panel formed with a hook-like projection along one edge, the hook-like projection defining a recess within which the overturned lip of the frame is retained when the panel is slidingly inserted into the channel defined by the frame.

Advantageously an edge of the retaining element engages each of the blade spindles when the retaining element is mounted upon the frame of the grille and prevents movement of the spindles towards the open end of the slots within which they are supported.

Preferably the retaining element comprises biasing means which engage the blade spindles when the retaining element is mounted upon the frame of the grille, the biasing means serving to urge the spindles towards the closed ends of the slots within which they are supported.

Conveniently the biasing means comprise a plurality of independent biasing members, each biasing member engaging a single spindle and urging that spindle towards the closed end of the slot in which it is supported.

Advantageously the frame of the grille is formed as a plastics moulding.

Preferably two retaining elements are provided for mounting an opposed part of the frame of the grille.

Conveniently the frame is of rectangular form having two pairs of opposed upstanding frame walls, each pair of opposed frame walls defining a plurality of slots which are open at one end and which receive spindles of blades supported within the frame, there being a first set of blades extending parallel with each other in a first direction and a second set of blades extending parallel with each other and extending substantially perpendicularly to the first set of blades.

Advantageously the slots defined in one pair of opposed frame walls are of greater depth than the slots defined in the other pair of opposed frame walls such that when the grille is assembled one set of blades are disposed behind the other.

Preferably the slots defined in one pair of opposed frame walls are generally keyhole-shaped, each slot comprising a tapering entrance extending into an enlarged opening, the spindle of a blade being received within the enlarged opening as a snap-fitting.

Conveniently an aperture is defined adjacent the junction between the tapering entrance and the enlarged opening such that part of this junction is bounded by a relatively thin web of material capable of flexing to permit the insertion of a blade spindle into the enlarged opening at the closed end of the slot.

According to a second aspect of this invention there is provided a mounting arrangement for mounting a grille adjacent an opening in a structural element at an outlet of a heating, ventilating or air conditioning system, the arrangement comprising a grille having a frame and a plurality of blades extending between opposed frame parts, the frame having a portion designed to project into the opening defined by the structural element and a portion which projects laterally to conceal the periphery of the opening when the grille is located in situ, the mounting arrangement further comprising a component mountable on the structural element which defines the opening at the outlet of the heating, ventilating or air conditioning system, the component and the grille frame being formed with co-operating snap-fitting connections located such that when the component is mounted on the structural element and the frame is passed into the opening defined by the structural element a connection is established between the component and the frame which serves to support the grille and which is concealed from view by the frame of the grille.

Preferably the component which is mountable upon the structural element comprises a frame of generally L-shaped cross section, the L-sectioned framed corresponding approximately in size to the size of the frame of the grille.

Conveniently the snap-fitting connection is established by means of outwardly extending projections formed on the frame of the grille engaging behind a free edge of one limb of the L-sectioned frame, said one limb of the L-sectioned frame projecting slightly inwardly such that as the frame is passed into the opening defined by the structural element the outwardly directed projections engage said one limb and the limb flexes outwardly until the projections snap behind the free edge of the limb.

In order that the present invention may be more readily understood and so that further features thereof may be appreciated the invention will now be described by way of example with reference to the accompanying drawings in which:

FIG. 3 is a cross-sectional view taken on the line III—III of FIG. 2;

FIG. 4 is a cross-sectional view taken on the line IV—IV of FIG. 2;

Figure 1:
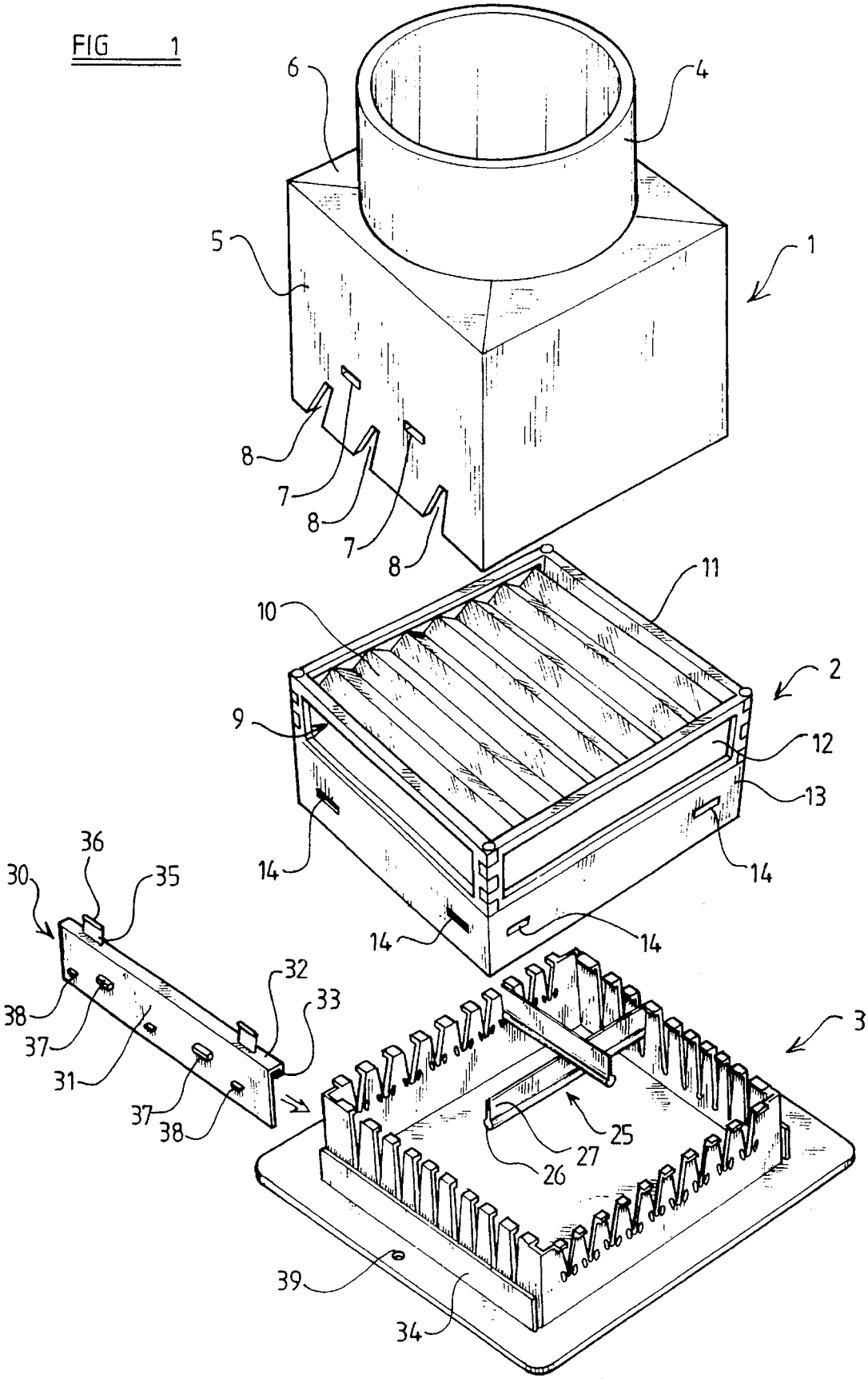
FIG. 1 is an exploded perspective view showing one example of a set of components to be located adjacent an outlet of a heating, ventilating or air conditioning system.
Figure 2:
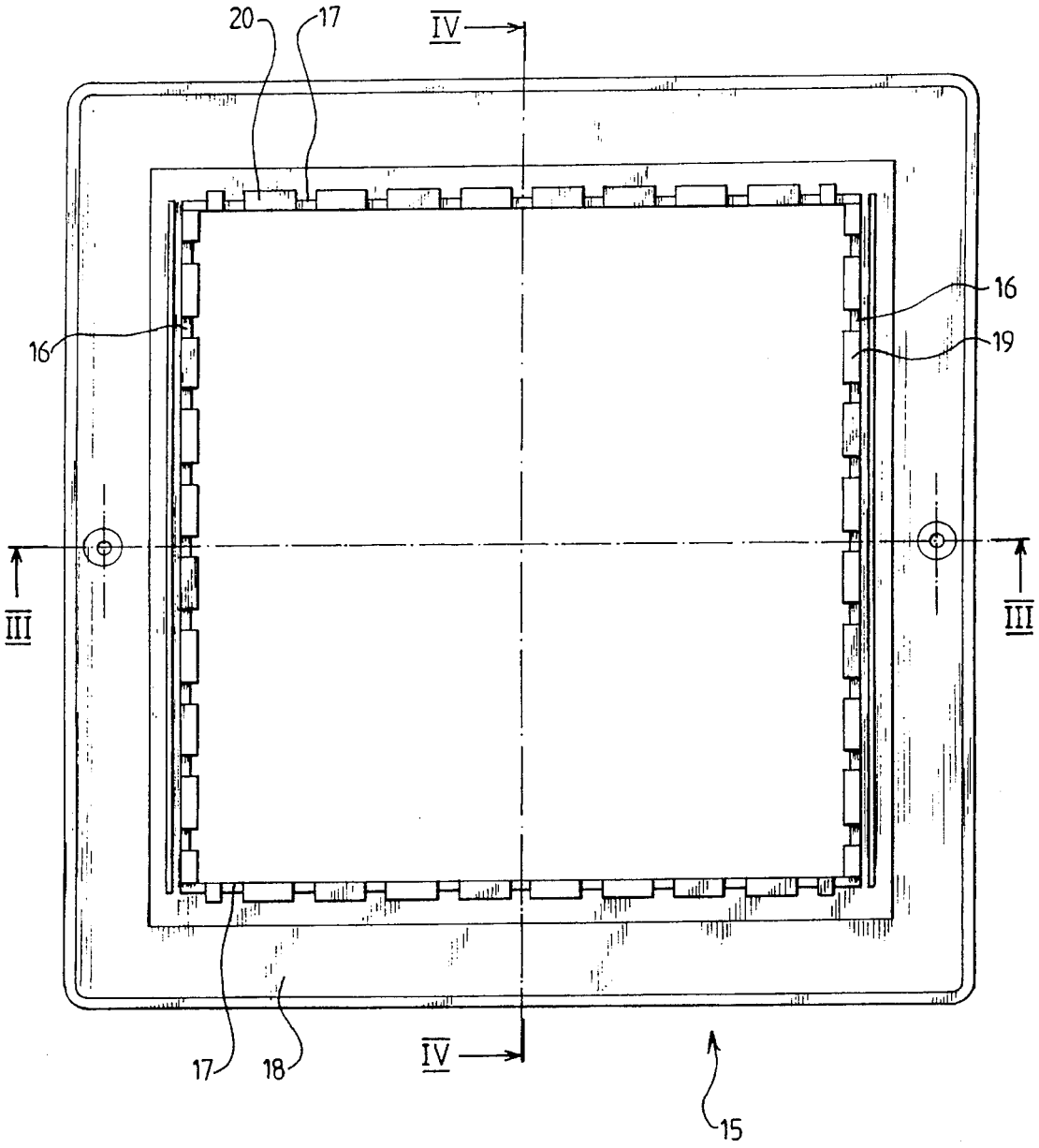
FIG. 2 is a plan view, from the rear, of a frame for a grille shown as the lowermost component in FIG. 1 of the drawings.

Referring initially to FIG. 1 of the drawings, one example of a set of components to be located at an outlet of a heating, ventilating or air conditioning system is shown, these components comprising a "neck reducer" 1, a damper 2 and a grille 3. All of the components illustrated in FIG. 1 of the drawings are formed as plastics mouldings and are designed to be interconnected by way of co-operating snap-fitting connections which do not require the use of any tools. When mounted in position at an outlet of a heating, ventilating or air conditioning system a flow of air will pass through these components by initially entering the neck reducer 1, then passing through the damper 2 which regulates the flow rate and then passing through the grille 3 to enter a space to be ventilated.

Looking at each of the components in slightly more detail, the neck reducer 1 comprises a circular inlet section 4 and a rectangular or square outlet section 5, there being a transition region 6 which provides for a gradual transition between the circular inlet 5 and the somewhat larger rectangular outlet 5. The circular inlet section 4 is designed to be connected to circular section ducting through which air is supplied and this connection may be effected by any appropriate means.

Each wall in one pair of opposed walls of the rectangular outlet section 5 of the neck reducer is formed with two rectangular apertures 7 at spaced apart positions almost one third of the way up the height of the rectangular outlet section 5. The apertures 7 form part of a snap-fitting connection between the neck reducer 1 and the grille 3, as will be described in greater detail hereinafter. The same opposed sides of the outlet section 5 as define the aperture 7 also define three spaced apart slots 8 extending upwardly from the free, lower edge of the outlet section, the slots extending upwardly to a position just below the level of the apertures 7. Across each of the opposed walls of the outlet section 5 the slots 8 alternate with the apertures 7 in such a way that the apertures 7 are each positioned between two slots 8. The slots 8 taper slightly as they extend into the outlet section 5 and are provided so that the outlet section of the neck reducer clears and does not engage projections provided on part of the grille 3, as will again be described in greater detail hereinafter.

The damper 3 comprises a rectangular frame 9 which is slightly smaller than the rectangular outlet 5 of the neck reducer 1 and a plurality of elongate blades 10 which extends between opposed sides of the rectangular frame. The blades 10 are movable between open and closed positions by being rotatable about their longitudinal axes. Adjacent blades are designed to rotate in opposite directions, such an arrangement being well known in existing "opposed blade" dampers. The frame 9 comprises four identical frame elements 11 which are interconnected at their corners by any appropriate means. By way of example the frame elements may each be formed at their opposite ends with projections and recesses designed to be interdigitated with co-operating projections and recesses on an adjacent frame element with a single vertical bore being defined through the interdigitated projections and receiving a pin or the like which serves to hold the two frame elements together at the comer joint. Each frame element 11 comprises an upper portion 12 defining a plurality of cylindrical bosses or the like within which the ends of the spindles of the blades 10 are supported and a depending wall 13 which defines a pair of spaced apart rectangular apertures 14 at positions approximately half way up the wall 13. The rectangular apertures 14 form one part of a snap-fitting connection between the damper 2 and the grille 3.

It will be appreciated that the damper blades 10 all extend parallel with each other between one pair of opposed frame elements 11 and whilst the other pair of frame elements 11 may also define bosses or the like suitable for receiving the ends of blade spindles, these will be redundant in practice. It is however convenient for all four of the frame elements 11 to be of identical form since this minimises the costs involved in producing the plastics moulded damper frame. This general type of "opposed blade" damper is well known in the field of heating, ventilating and air conditioning system and will therefore not be described in any further detail. The damper may be provided with means enabling the setting of the blades 10 to be adjusted easily so that the rate of flow through the damper can be regulated. Again such means are already known in existing damper designs.

The various features of the grille 3 are shown in FIGS. 1 to 5. The grille comprises a rectangular frame 15 having two pairs of opposed, like upstanding walls 16, 17 and a flange 18 which projects outwardly from the lower edge of the upstanding wall. The upper edges of the opposed upstanding walls 16 are each formed with a short inwardly directed lip 19 whilst the upper edges of the opposed upstanding walls 17 are each formed with a short outwardly directed lip 20.

Both pairs of opposed upstanding walls 16, 17 are formed with slots which extend into the walls from their free upper edges. Thus, each of the opposed walls 16 defines a plurality of open ended slots 21 which extend downwardly from the upper edge of the walls 16 (see FIG. 4). The slots 21 taper slightly as they extend downwardly and are each formed with a rounded base or closed end. The slots 21 extend down over a major proportion of the depth of each of the upstanding walls 16. The opposed walls 17 are also formed with a plurality of open ended slots identified by reference numeral 22 (See FIG. 3). The slots 22 extend downwardly from the free upper edge of each of the walls 17 and are of keyhole-configuration. Thus, each slot 22 defines a tapering entrance 23 extending into an enlarged opening 24 at its closed end. The slots 22 extend downwardly over only a minor proportion of the depth of the walls 17 and it can readily be seen from a comparison of FIGS. 3 and 4 that the bases of the slots 22 are disposed at a much higher position the bases of the slots 21. In the particular embodiment illustrated there are nine pairs of opposed slots 21 and nine pairs of opposed slots 22.

The slots 21, 22 are designed to support opposed ends of blades 25 provided on the grille frame. The particular frame illustrated is designed to carry two sets of blades, one set of blades extending parallel with each other between the opposed walls 16 and a second set of blades extending parallel with each other between the opposed walls 17 at a slightly higher level or behind the blades extending between the walls 16. The two sets of blades therefore extend at right angles to each other.

The blades themselves are all of an identical design and each comprise an integrally moulded component having a circular spindle 26 running along one edge thereof and a flap or blade portion 27 which tapers slightly as it extends away from the spindle 26. The opposite ends of the spindle 26 extend slightly beyond the ends of the blade portion 27 so that they project and can be inserted into the slots 21, 22 so as to be supported upon the grille frame.

The blades 25 are designed to be received in the slots 22 in the opposed walls 17 as a snap-fitting. Thus, each end of the spindle 26 of each blade is designed to snap into the enlarged opening 24 at the base of one of the keyhole-shaped slots 22. In order to mount the blades in the slots 22 the spindles 26 must be forced past the relatively narrow junction between the tapering entrance 23 and the enlarged opening 24. In order to facilitate the passage of the spindle 26 into the enlarged opening 24 a pair of apertures 28 is formed adjacent the junction between the tapering entrance 23 and the enlarged opening 24 on either side of each slot 22. The apertures 28 result in this junction being bounded by a relatively thin web of material 29 which is capable of flexing in order to allow the spindles 26 of the blades 25 to snap into the enlarged openings 24 at the bases of the slots 22.

The other set of blades is supported by the opposed walls 16 by dropping the ends of the blade spindles 26 into the opposed slots 21 so that the ends of the spindles drop down and are supported by the closed ends of the slots 21. A pair of retaining elements 30 are provided which are mountable upon the frame 15 adjacent the opposed walls 16 in order to retain the blade spindles 26 adjacent the bases of the slots 21. Only one retaining element 30 is illustrated in FIG 1 of the drawings but a corresponding element is provided on the opposite side of the grille frame to be mounted adjacent the opposite upstanding wall 16.

Each retaining element 30 is of panel-like form comprising a vertical panel 31 formed at its upper end with an inwardly directed hook-like formation 32 which defines a recess 33 corresponding in shape to that of the inwardly directed lip 19 formed on each of the upstanding walls 16 of the grille frame. Each retaining element 30 is designed to be slidingly received within a channel defined between the upstanding wall 16 of the grills frame and a further upstanding projection 34 which extends upwardly from the flange 18 of the grille frame parallel to the upstanding wall 16. There is, of course, an upstanding wall or projection 34 on each side of the grille frame adjacent each of the walls 16 so that a channel is defined on each side of the grille frame to receive a respective retaining element 30. The retaining elements 30 used on either side of the grille frame are a mirror image of each other. The upstanding projection 34 extends upwardly over slightly less than half the height of the upstanding wall 16 of the grille frame.

Figure 5:
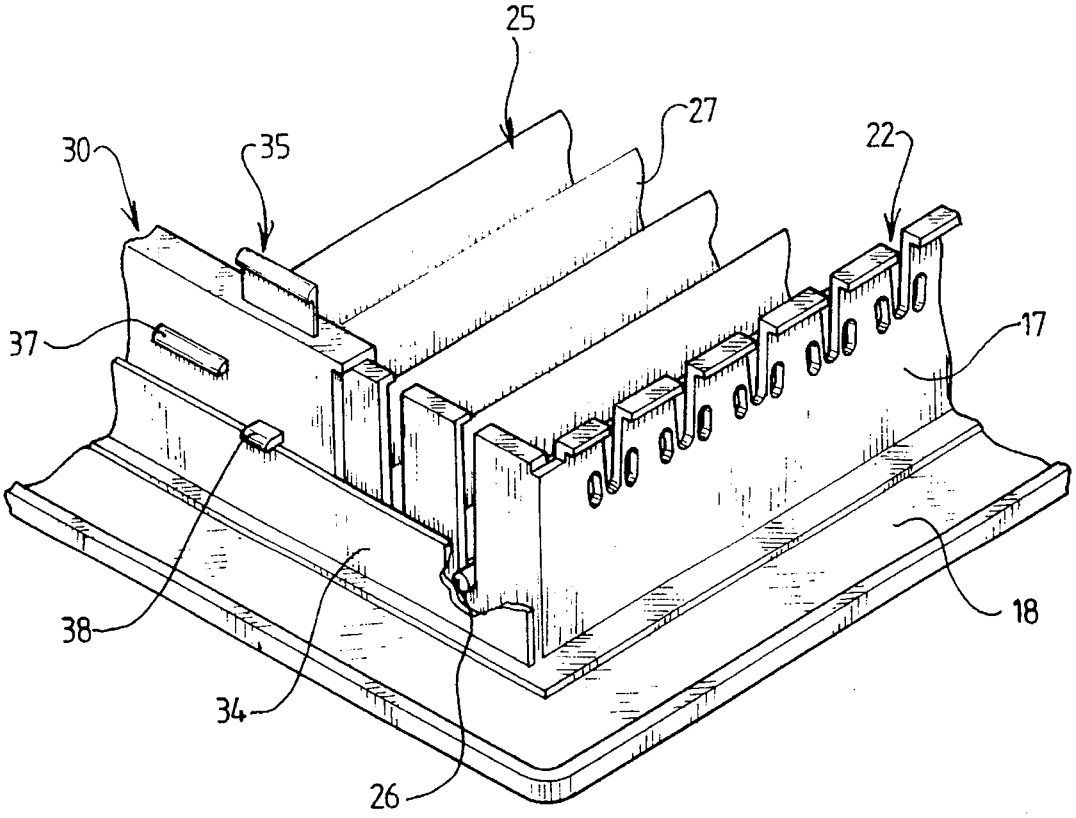
FIG. 5 is an enlarged perspective view showing one corner region of the frame of FIGS. 2, 3 and 4 with a number of blades and a blade retaining element shown in position on the frame.

As is best illustrated in FIG. 5 of the accompanying drawings, each retaining element is slidingly introduced into a respective channel on one side of the grille frame with the inwardly directed lip 19 being received within the recess 33 defined by the hook-like formation at the top of the retaining element. When the retaining element is introduced into the channel in this way the lower most portion of the panel 31 is held in place between the upstanding walls 16 and the upstanding projection 34. The wall 31 is of such a height that its lowermost edge will just engage upon the upwardly directed surface of each of the blade spindles 26 which project through the slots 21 and into the channel between the upstanding wall 16 and the upstanding projection 34. In this way the lowermost edge of the retaining element 30 serves to hold the ends of the blade spindles adjacent the closed ends of the slots 21 and prevents movement of the blade spindles towards the open, upper end of the slots. Thus the blades are held captively in place and even if, when the grille is mounted in situ, a person presses against the blades they will not tend to move rearwardly.

The blade mountings do, of course, permit the blades to rotate about the axes of their spindles so that they can be adjusted in order to vary the direction in which a flow of air is guided as it passes through the grille. The engagement of the retaining element with the ends of the spindles 26 serves to retain the blades in a position to which they are set but still permits adjustment of the setting. Similarly the blades 25 which extend between the opposed walls 17 are held sufficiently firmly within the enlarged openings 24 at the bases of the slots 22 that they will remain in a position to which they are set but can still be rotated about the longitudinal axes of the spindles 26 if it is desired to adjust the blade setting.

The uppermost edge of the hook-like formation 32 at the top of the panel 31 carries two upstanding resilient fingers 35, each of which carries an outwardly directed tooth 36 at its uppermost edge. The resilient fingers 35 are designed to form a snap-fitting connection with the apertures 14 in the lower portion 13 of one opposed pair of frame elements 11 of the damper 2. In addition the panel 31 defines a pair of spaced apart outwardly directed projections 37 which are designed to form a snap-fitting connection with the apertures 7 in the opposed walls of the outlet section 5 of the neck reducer 1. The panel 31 also defines three spaced apart outwardly directed projections 38 at positions slightly below the level of the projections 37 and offset from the position of the projections 37 along the length of the panel. Projections 38 are designed to form part of a mounting arrangement for mounting the grille 3 in position adjacent an opening formed in a wall or ceiling.

In order to assemble the various components shown in FIG. 1 of the drawings, a first set of blades 25 are mounted on the grille frame 15 by introducing the ends of the blade spindles 26 into the opposed slots 21. When all the blades have been located upon the frame in this way a retaining element 30 is slidingly located in position adjacent each of the opposed walls 16 of the grille frame in order to retain the first set of blades in position upon the frame. A second set of blades 25 is then mounted upon the frame, the blades extending between the opposed walls 17 at right angles to the first set of blades. These blades are mounted in position by inserting the ends of each blade spindle into opposed slots 22, forcing the spindles down into the enlarged opening 24 formed at the base of each slot 22.

The grille is now fully assembled and the damper 2 can be mounted thereon. The damper is mounted upon the grille by simply lowering it onto the rear of the grille. The grille and the damper are so dimensioned that the aperture 14 in the damper frame are automatically aligned with the resilient fingers 35 formed on the retaining elements 30 and the outwardly directed teeth 36 on the resilient fingers snap into the apertures 14 in order to secure the damper upon the grille. The neck reducer 1 may then be mounted upon the grille and this is done by passing the outlet section 5 of the neck reducer over the damper and over the upstanding walls of the grille frame. Again the outlet section of the neck reducer 1 and the grille are so dimensioned that as the neck reducer is passed over the damper and the grille the outwardly extending projections 38 are aligned with and pass into the slots 8 formed in the opposed walls of the outlet section of the neck reducer and the outwardly directed projections 37 are automatically aligned with and snap into the apertures 7, thereby retaining the neck reducer 1 in position upon the back of the grille.

Figure 6:
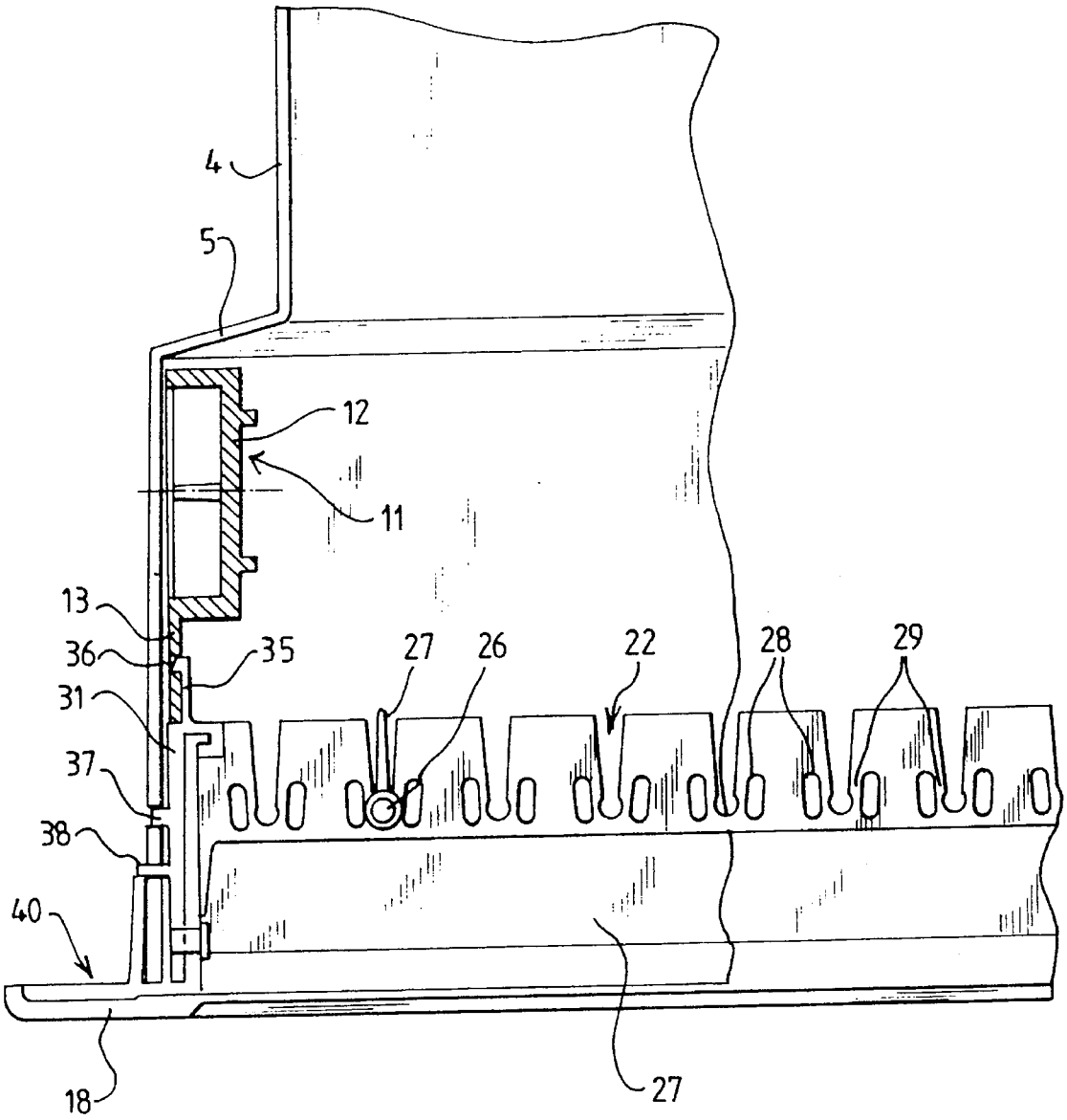
FIG. 6 is a partial vertical cross-sectional view through the components of FIG. 1 when they are assembled.

The components are now fully assembled and can be mounted in position at an outlet of a heating, ventilating or air conditioning system with ducting being connected to the inlet section 4 of the neck reducer by any appropriate means. The grille will then be mounted on the wall or ceiling where the outlet of the heating, ventilating or air conditioning system is located and this may be effected in one of two possible ways. Firstly screws may be passed through screw holes 39 formed in the flange 18 of the grille frame, the screws passing into the wall or ceiling in order to mount the grille in position. This is, however, sometimes rather unsightly and an awkward operation. In an alternative arrangement the flange 18 of the grille frame be formed without any screw holes in order to provide it with a more pleasing appearance. In this case the grille may be mounted in position at the outlet by initially securing a sub-frame 40 in position around an opening formed in a wall or ceiling and then connecting the grille frame to the sub-frame. The sub-frame 40 is illustrated in FIG. 6 of the drawings and comprises a generally L-sectioned frame corresponding in size to the frame of the grille. The sub-frame may be screwed or otherwise secured in position upon a wall or ceiling so that one limb of the frame passes into the opening formed in the wall or ceiling whilst the other limb of the frame extends outwardly adjacent the wall or ceiling. The limb of the sub-frame which passes into the opening in a wall or ceiling is angled slightly inwardly as can be seen in FIG. 6. The grille 3 can then be mounted upon the sub-frame 40 by simply pushing the grille, and the other components connected thereto, into the opening in the wall or ceiling whereupon the outwardly extending projections 38 on each of the retaining elements 30 come into engagement with the limb of the frame 40 which passes into the opening and forces that limb of the sub-frame to flex outwardly until the projections 38 snap past the free end of that limb of the sub-frame whereupon the grille is automatically held in position upon the sub-frame.

This results in a mounting for the grille, and the other components connected thereto, which is not visible from the front of the grille. Thus a particularly pleasing appearance is obtained. Furthermore the mounting of the grille is made somewhat simpler because it is not necessary to take great care in passing screws through the sub-frame 40 because this will be concealed when the grille is mounted in position. The actual mounting of the grille merely involves pushing the grille and any components connected thereto into the opening formed in the wall or ceiling whereupon it automatically snaps into position and is held in place on the sub-frame 40. It would of course be possible to install the neck reducer 1 in position first by connecting it to ducting forming part of a heating, ventilating or air condition system and then to insert the assembled damper and grille into the neck reducer. It is to be appreciated that this mounting arrangement, which provides a hidden fixing, could be used with other types of grilles, such as an integrally moulded grille having a single set of fixed blades extending between opposed parts of the grille frame.

Various modifications may be made to the specific embodiment described above. For example, the retaining elements 30 may each be provided with biasing means, such as a leaf spring-like member which engages the ends of the blade spindles when the retaining element is mounted upon the frame of the grille the spring member serving to urge the blade spindles towards the closed end of the slots 21. If desired a plurality of independent springs or similar biasing means may be provided on each retaining element 30, there being one spring or like biasing means to engage the end of each spindle 26 and urge it towards the closed end of its respective slot 21.

It would, of course, be possible to omit one set of blades 25 and for the grille simply to carry a single set of parallel blades extending between one pair of opposed frame walls. If, in such a modified arrangement the slots for receiving the blade spindles were all of the keyhole-type such as the slots 22 then the retaining elements 30 would not be required and the resilient fingers 35 and the projections 37, 38 could be formed on the walls of the frame 15 of the grille. Thus, in a basic arrangement the grille may have only a single set of blades which are supported in keyhole-shaped slots. It is to be appreciated that in some systems it may not be necessary to provide the damper 2 and, if desired, this can simply be omitted. Indeed, in some situations it may even be possible to omit the neck reducer 1 with the grille 3 being provided purely as a decorative cover over an outlet or opening at one end of a heating ventilating or; air conditioning conduit.

We claim:

1. A grille for use adjacent an outlet of a heating, ventilating or air conditioning system, the grille comprising a frame and a plurality of blades extending between opposed frame parts, each blade having a spindle which is rotatably supported within opposed slots formed in the opposed parts of the frame, the slots having an open end to permit the insertion of a blade spindle therein and a closed end, the spindle being supported at the closed ends of the slots, the grille further comprising means for retaining the blade spindle in the slots, the retaining means comprising a separate retaining element configured as a substantially planar component mountable on the frame of the grille, the frame defining a channel between two substantially parallel walls and the retaining element being configured to be slidingly inserted into the channel upon the frame such that part of the retaining element is located between the two substantially parallel walls and engages the blade spindle when mounted upon the frame and prevents the spindle from moving out of the open ends of the slots.

2. A grille according to claim 1 wherein the frame of the grille comprises an upstanding wall formed with an overturned lip at its upper edge, the retaining element comprising a panel formed with a hook-like projection along one edge, the hook-like projection defining a recess within which the overturned lip of the frame is retained when the panel is slidingly inserted into the channel defined by the frame.

3. A grille according to claim 1 wherein an edge of the retaining element engages each of the blade spindles when the retaining element is mounted upon the frame of the grille and prevents movement of the spindles towards the open end of the slots within which they are supported.

4. A grille according to claim 1 wherein the retaining element comprises biasing means which engage the blade spindles when the retaining element is mounted upon the frame of the grille, the biasing means serving to urge the spindles towards the closed ends of the slots within which they are supported.

5. A grille according to claim 4 wherein the biasing means comprise a plurality of independent biasing members, each biasing member engaging a single spindle and urging that spindle towards the closed end of the slot in which it is supported.

6. A grille according to claim 1 wherein the frame of the grille is formed as a plastics moulding.

7. A grille according to claims 1 wherein two retaining elements are provided for mounting on opposed part of the frame of the grille.

8. A grille according to claims 1 wherein the frame is of rectangular form having two pairs of opposed upstanding frame walls, each pair of opposed frame walls defining a plurality of slots which are open at one end and which receive spindles of blades supported within the frame, there being a first set of blades extending parallel with each other in a first direction and a second set of blades extending parallel with each other and extending substantially perpendicularly to the first set of blades.

9. A grille according to claim 8 wherein the slots defined in one pair of opposed frame walls are of greater depth than the slots defined in the other pair of opposed frame walls such that when the grille is assembled one set of blades are disposed behind the other.

10. A grille according to claim 8 wherein the slots defined in one pair of opposed frame walls are generally keyhole-shaped, each slot comprising a tapering entrance extending into an enlarged opening, the spindle of a blade being received within the enlarged opening as a snap-fitting.

11. A grille according to claim 10 wherein an aperture is defined adjacent the junction between the tapering entrance and the enlarged opening such that part of this junction ie bounded by a relatively thin web of material capable of flexing to permit the insertion of a blade spindle into the enlarged opening at the closed end of the slot.

12. An arrangement for mounting a grille adjacent an opening defined by a structural element at an outlet of a heating, ventilating or air conditioning system, the grille having a frame and a plurality of blades, the frame having opposed frame parts, the blades extending between the opposed frame parts, the frame having a portion designed to project into the opening defined by the structural element and a portion which projects laterally to conceal the periphery of the opening when the grille is located in situ, the mounting arrangement further comprising a support component mounted on the structural element which defines the opening at the outlet of the heating, ventilating or air conditioning system, the support component being mounted on the structural element so as to be located around the periphery of the opening in the structural element, the support component and the grille frame being formed with co-operating snap-fitting connections located such that when the frame is passed into the opening defined by the structural element a snap-fitting connection is established between the support component and the frame, the connection serving to support the grille and being concealed from view by the frame of the grille.

13. A mounting arrangement according to claim 12 wherein the support component is of frame-like form and of generally L-shaped cross section, the frame-like support component corresponding approximately in size to the size of the frame of the grille.

14. A mounting arrangement according to claim 13 wherein the snap-fitting connection established between the support component and the grille frame upon insertion of the grille frame with the opening defined by the structural element is formed by means of outwardly extending projections on the frame of the grille engaging behind a free edge of a part of the support component, said part of the support component projecting slightly inwardly such that as the frame is passed into the opening defined by the structural element the outwardly directed projections engage said part and the part flexes outwardly until the projections snap behind said free edge of the part.

* * * * *

UNITED STATES PATENT AND TRADEMARK OFFICE

CERTIFICATE OF CORRECTION

PATENT NO. : 5,586,933

DATED : December 24, 1996

INVENTOR(S) : Colin Sawyer, John Wallis and Peter Bartingale

It is certified that error appears in the above-indentified patent and that said Letters Patent is hereby corrected as shown below:

Column 1 Line 32 "grille ie" should read --grill is--.

Column 3 Line 11 "L-sectioned framed" should read --L-sectioned frame--.

Column 4 Line 35 "comer" should read --corner--.

Column 4 Line 64 "wall." should read --walls.--.

Column 5 Line 18 after "position" insert --than--.

Column 5 Line 62 "FIG 1" should read --FIG. 1--.

Column 6 Line 6 "grills" should read --grille--.

Column 7 Line 15 "aperture" should read --apertures--.

Column 7 Line 45 after "frame" insert --may--.

Column 8 Line 15 "air condition" should read --air conditioning--.

Column 8 Line 50 after "heating" insert --,--.

Column 8 Line 50 after "or" delete --;--.

--

UNITED STATES PATENT AND TRADEMARK OFFICE

CERTIFICATE OF CORRECTION

PATENT NO. : 5,586,933

DATED : December 24, 1996

INVENTOR(S) : Colin Sawyer, John Wallis and Peter Bartingale

It is certified that error appears in the above-indentified patent and that said Letters Patent is hereby corrected as shown below:

Claim 7 Column 9 Line 29 "claims" should read --claim--.

Claim 7 Column 9 Line 30 "part" should read --parts--.

Claim 8 Column 9 Line 32 "claims" should read --claim--.

Claim 11 Column 10 Line 5 "junction ie" should read --junction is--.

Signed and Sealed this

Eighth Day of July, 1997

Bruce Lehman

*Attest:*

BRUCE LEHMAN

*Attesting Officer*

*Commissioner of Patents and Trademarks*